US012195289B2

(12) United States Patent
Swann et al.

(10) Patent No.: US 12,195,289 B2
(45) Date of Patent: Jan. 14, 2025

(54) REEL HANDLING MACHINE

(71) Applicant: TE Connectivity Solutions GmbH, Schaffhausen (CH)

(72) Inventors: Anthony L. Swann, Asheville, NC (US); Craig Roper, Middletown, PA (US); Sun Kyu Pak, Harrisburg, PA (US); Edward Niswander Meyers, Middletown, PA (US); Swapnilsinh Solanki, Harrisburg, PA (US); Roberto Francisco-Yi Lu, Bellevue, WA (US)

(73) Assignee: TE Connectivity Solutions GmbH (CH)

( * ) Notice: Subject to any disclaimer, the term of this patent is extended or adjusted under 35 U.S.C. 154(b) by 287 days.

(21) Appl. No.: 17/848,518

(22) Filed: Jun. 24, 2022

(65) Prior Publication Data

US 2023/0416035 A1 Dec. 28, 2023

(51) Int. Cl.
*B65H 18/08* (2006.01)
*B65H 16/00* (2006.01)
(Continued)

(52) U.S. Cl.
CPC ..... *B65H 18/08* (2013.01); *B65H 16/00* (2013.01); *B65H 16/04* (2013.01); *B65H 16/103* (2013.01);
(Continued)

(58) Field of Classification Search
CPC ..... B65H 16/00; B65H 16/02; B65H 16/021; B65H 16/023; B65H 16/024; B65H 16/04; B65H 16/103; B65H 18/00; B65H 18/02; B65H 18/021; B65H 18/0212; B65H 18/026; B65H 18/04; B65H 18/08; B65H 18/10; B65H 18/103; B65H 18/106; B65H 18/14; B65H 18/145; B65H 18/28; B65H 19/00; B65H 19/10; B65H 19/12; B65H 19/123; B65H 19/1857; B65H 19/1863; B65H 19/1868; B65H 19/1873; B65H 19/1978; B65H 19/1889; B65H 19/22; B65H 19/2207; B65H 19/2215;
(Continued)

(56) References Cited

U.S. PATENT DOCUMENTS 221,462 A * 11/1879 Hoe ..... B65H 19/30 242/542.3
2,827,961 A * 3/1958 Pugh ..... B26D 1/035 242/525
(Continued)

FOREIGN PATENT DOCUMENTS

EP 3828110 A1 * 6/2021 ..... B65H 18/145
WO WO-2023170269 A1 * 9/2023 ..... B65H 19/30

*Primary Examiner* — Michael R Mansen
*Assistant Examiner* — Raveen J Dias

(57) ABSTRACT

A reel handling machine includes first and second re-reeling assemblies coupled to a frame. The re-reeling assemblies each include a reel mount supporting a first reel and a re-reel mount supporting a second reel. The re-reeling assemblies operated to unwind a product strip from the first reel and rewind the product strip on the second reel. The reel handling machine includes a reel manipulator positioned proximate to the re-reeling assemblies configured to automatically remove the second reel from the re-reel mount after the product strip is rewound on the second reel and move the second reel to a remote location.

20 Claims, 4 Drawing Sheets

(51) Int. Cl.

| | |
|---|---|
| ***B65H 16/04*** | (2006.01) |
| ***B65H 16/10*** | (2006.01) |
| ***B65H 18/02*** | (2006.01) |
| ***B65H 18/10*** | (2006.01) |
| ***B65H 18/28*** | (2006.01) |
| ***B65H 19/00*** | (2006.01) |
| ***B65H 19/12*** | (2006.01) |
| ***B65H 19/18*** | (2006.01) |
| ***B65H 19/22*** | (2006.01) |
| ***B65H 19/29*** | (2006.01) |
| ***B65H 19/30*** | (2006.01) |

(52) U.S. Cl.
CPC ..... *B65H 18/026* (2013.01); *B65H 18/103* (2013.01); *B65H 18/28* (2013.01); *B65H 19/00* (2013.01); *B65H 19/12* (2013.01); *B65H 19/123* (2013.01); *B65H 19/1857* (2013.01); *B65H 19/1863* (2013.01); *B65H 19/1889* (2013.01); *B65H 19/2207* (2013.01); *B65H 19/223* (2013.01); *B65H 19/2284* (2013.01); *B65H 19/29* (2013.01); *B65H 19/30* (2013.01); *B65H 2301/41* (2013.01); *B65H 2301/41352* (2013.01)

(58) Field of Classification Search
CPC ..... B65H 19/2223; B65H 19/223; B65H 19/2284; B65H 19/30; B65H 23/1806; B65H 2301/41; B65H 2301/41352; B65H 2301/4139; B65H 2301/41394; B65H 2301/41486; B65H 2701/1944; B65H 49/20; B65H 49/26; B65H 49/32; B65H 49/325; B65H 49/328
See application file for complete search history.

(56) References Cited

U.S. PATENT DOCUMENTS 3,188,016 A * 6/1965 Aaron ..... B65H 18/106 242/542.3
3,258,136 A * 6/1966 Rockstrom ..... B65H 19/2284 414/226.01
3,332,636 A * 7/1967 Rockstrom ..... B65H 19/2284 242/542.3
3,525,479 A * 8/1970 Hans ..... D06B 3/32 242/413.7
3,539,127 A * 11/1970 Grawey ..... B65H 19/2253 242/542.3
3,999,665 A * 12/1976 Rogers ..... B21C 47/006 414/800
4,063,692 A * 12/1977 Buggy ..... B65H 18/106 242/415.1
4,155,238 A * 5/1979 Rogers ..... B65H 18/103 72/204
4,173,313 A * 11/1979 Rogers ..... B65H 16/103 242/534
4,208,019 A * 6/1980 Dusenbery ..... B65H 19/30 242/530.4
4,607,804 A * 8/1986 Urlik ..... G03B 21/43 242/534
4,625,930 A * 12/1986 Urlik ..... G03B 21/43 242/356.5
4,629,139 A * 12/1986 Sanda ..... B65H 16/103 242/415.1
4,821,972 A * 4/1989 Grollimund ..... B65H 19/123 901/6
5,219,127 A * 6/1993 Boldrini ..... B65H 19/123 242/559.1
5,445,341 A * 8/1995 Martin ..... B65H 19/1863 242/527.3
5,692,698 A * 12/1997 Forbes ..... B65H 37/002 242/559.2
5,799,898 A * 9/1998 Sumida ..... B65H 19/2284 242/533.7
6,276,628 B1 * 8/2001 Focke ..... B21C 47/242 414/427
6,283,402 B1 * 9/2001 Fordham ..... B65H 18/106 242/530.4
6,497,384 B1 * 12/2002 Fujiwara ..... B65H 18/14 242/527
6,592,065 B1 * 7/2003 Tsou ..... B65H 23/1888 242/417.3
7,631,832 B1 * 12/2009 Chen ..... B65H 19/126 242/533.4
9,517,909 B2 * 12/2016 Bauer ..... B65H 18/08
9,573,713 B2 * 2/2017 Huber ..... B65H 19/12
10,822,190 B2 * 11/2020 Pasqualoni ..... B29C 66/853
11,479,429 B2 * 10/2022 Giansante ..... B65H 3/0808
11,866,278 B2 * 1/2024 Baldaccini ..... B65H 19/2207
2003/0032538 A1 * 2/2003 Spatafora ..... B65H 19/123 493/81
2006/0051185 A1 * 3/2006 Spatafora ..... B65H 19/123 414/222.01
2014/0048642 A1 * 2/2014 Bauer ..... B65H 18/10 242/520
2014/0070043 A1 * 3/2014 Naipany ..... B65H 54/026 242/472.8
2015/0175382 A1 * 6/2015 Seifert ..... B65H 18/106 242/397
2015/0175383 A1 * 6/2015 Seifert ..... B65H 18/10 242/389
2016/0060059 A1 * 3/2016 Macura ..... B65H 19/123 242/555.1
2016/0060060 A1 * 3/2016 Macura ..... B65H 16/04 242/558
2017/0233206 A1 * 8/2017 Wimmer ..... B65H 19/123 242/554
2017/0247214 A1 * 8/2017 Wimmer ..... B65H 19/12
2017/0260018 A1 * 9/2017 Hack ..... B65H 67/0411
2017/0320691 A1 * 11/2017 Leicht ..... B65H 18/026
2017/0327338 A1 * 11/2017 Vergentini ..... B65H 19/265
2017/0327339 A1 * 11/2017 Vergentini ..... B65H 23/032
2018/0141772 A1 * 5/2018 Prankl ..... B65H 19/12
2018/0312357 A1 * 11/2018 Tunioli ..... B65H 19/123
2019/0301099 A1 * 10/2019 Montagnani ..... D21F 11/006
2019/0315587 A1 * 10/2019 Nagafuchi ..... B65H 19/12
2019/0337747 A1 * 11/2019 Nagafuchi ..... B65H 16/04
2020/0048023 A1 * 2/2020 Lucas ..... B65H 23/044
2020/0055686 A1 * 2/2020 Paladini ..... B65H 18/10
2020/0254711 A1 * 8/2020 Ruhland ..... B65B 69/0025
2020/0255997 A1 * 8/2020 Noh ..... A47L 13/16
2021/0122597 A1 * 4/2021 Hernando Saiz ..... B65H 19/30
2021/0179377 A1 * 6/2021 Cuevas Padilla .... B65H 18/145
2021/0339974 A1 * 11/2021 Baldaccini ..... B65H 19/223
2021/0354945 A1 * 11/2021 Deng ..... B25J 15/04
2022/0289510 A1 * 9/2022 Yang ..... B65H 19/305
2022/0315370 A1 * 10/2022 Capitani ..... B65C 9/28
2022/0317003 A1 * 10/2022 Lazzareschi ..... B65H 19/30
2022/0356041 A1 * 11/2022 Hong ..... B65H 67/052
2023/0123540 A1 * 4/2023 Cao ..... B65H 19/286 242/532.3
2023/0183037 A1 * 6/2023 Passarella ..... B65H 75/24 242/570
2023/0402301 A1 * 12/2023 Kizaki ..... H01L 21/30
2024/0051692 A1 * 2/2024 Robèrt ..... B65B 25/24

* cited by examiner

REEL HANDLING MACHINE

BACKGROUND OF THE INVENTION

The subject matter herein relates generally to reel handling machines.

Cardboard reels are used commonly in manufacturing lines to store raw materials and finished goods. For example, electrical contacts, arranged along a carrier strip, may be wound on a reel as a product strip. The product strip is unwound into a machine, such as a termination machine or leadmaker machine to terminate the contacts to wires or leads or a contact loading machine to load the contacts into a connector housing. The machines require that the product strip be wound in a particular winding direction. However, some machines require the product strip be wound in a clockwise direction and other machines require the product strip be wound in a counterclockwise direction. Rewinding the reels to change the winding orientation is a time consuming process. Currently most of the tasks are done by human, which requires much labor and have safety concerns.

A need remains for adaptive, automated reel handling machine.

BRIEF DESCRIPTION OF THE INVENTION

In one embodiment, a reel handling machine is provided and includes a frame. The reel handling machine includes a first re-reeling assembly coupled to the frame. The first re-reeling assembly includes a first reel mount and a first re-reel mount. The first reel mount configured to support a first reel. The first re-reel mount configured to support a second reel. The first re-reeling assembly operated to unwind a product strip from the first reel and rewind the product strip on the second reel. The reel handling machine includes a second re-reeling assembly coupled to the frame. The second re-reeling assembly includes a second reel mount and a second re-reel mount. The second reel mount configured to support a third reel. The second re-reel mount configured to support a fourth reel. The second re-reeling assembly operated to unwind a product strip from the third reel and rewind the product strip on the fourth reel. The reel handling machine includes a reel manipulator positioned proximate to the first and second re-reeling assemblies. The reel manipulator configured to automatically remove the second reel from the first re-reel mount after the product strip is rewound on the second reel and move the second reel to a remote location. The reel manipulator configured to automatically remove the fourth reel from the second re-reel mount after the product strip is rewound on the fourth reel and move the fourth reel to a remote location.

In another embodiment, a reel handling machine is provided and includes a frame. The reel handling machine includes a re-reeling assembly coupled to the frame. The re-reeling assembly includes a reel mount and a re-reel mount. The reel mount configured to support a first reel. The re-reel mount configured to support a second reel. The re-reeling assembly operated to unwind a product strip from the first reel and rewind the product strip on the second reel. The reel handling machine includes a reel manipulator positioned proximate to the re-reeling assemblies. The reel manipulator configured to automatically remove the second reel from the re-reel mount after the product strip is rewound on the second reel and move the second reel to a remote location. The reel handling machine includes a reel taping mechanism coupled to the frame. The reel taping mechanism has a tape applicator configured to apply tape across flanges of the second reel. The reel manipulator positions the second reel at the reel taping mechanism while the tape is applied across the flanges of the second reel.

In a further embodiment, a reel handling machine is provided and includes a frame. The reel handling machine includes a re-reeling assembly coupled to the frame. The re-reeling assembly includes a reel mount and a re-reel mount. The reel mount configured to support a first reel. The re-reel mount configured to support a second reel. The re-reeling assembly operated to unwind a product strip from the first reel and rewind the product strip on the second reel. The reel handling machine includes a reel manipulator positioned proximate to the re-reeling assemblies. The reel manipulator configured to automatically remove the second reel from the re-reel mount after the product strip is rewound on the second reel and move the second reel to a remote location. The reel handling machine includes a reel labeling mechanism coupled to the frame. The reel labeling mechanism having a label applicator configured to apply a label to a side of the second reel. The reel manipulator positions the second reel at the reel labeling mechanism while the label is applied to the side of the second reel.

DETAILED DESCRIPTION OF THE INVENTION

Figure 1:
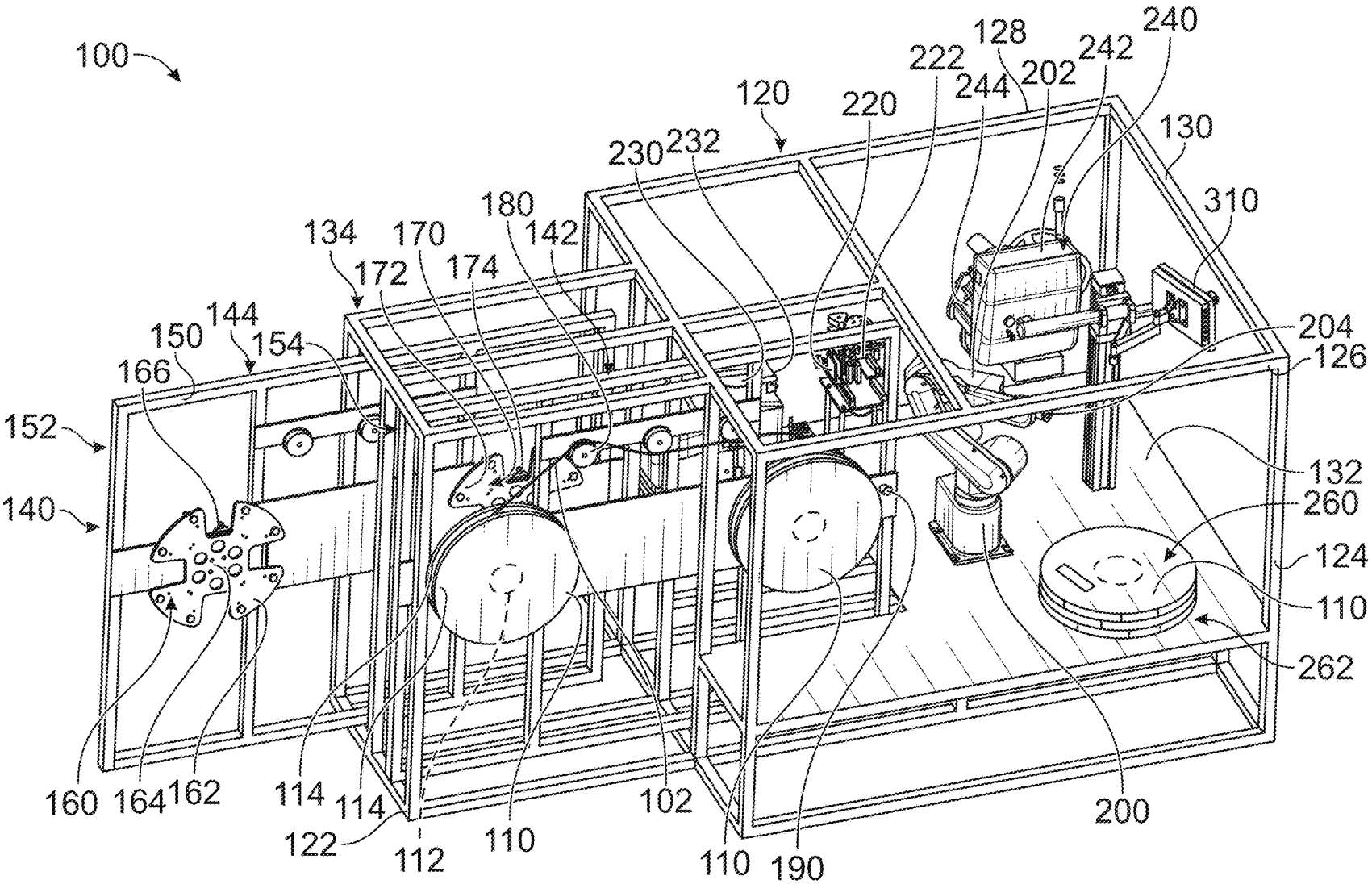
FIG. 1 is a front left perspective view of a reel handling machine in accordance with an exemplary embodiment.
Figure 2:
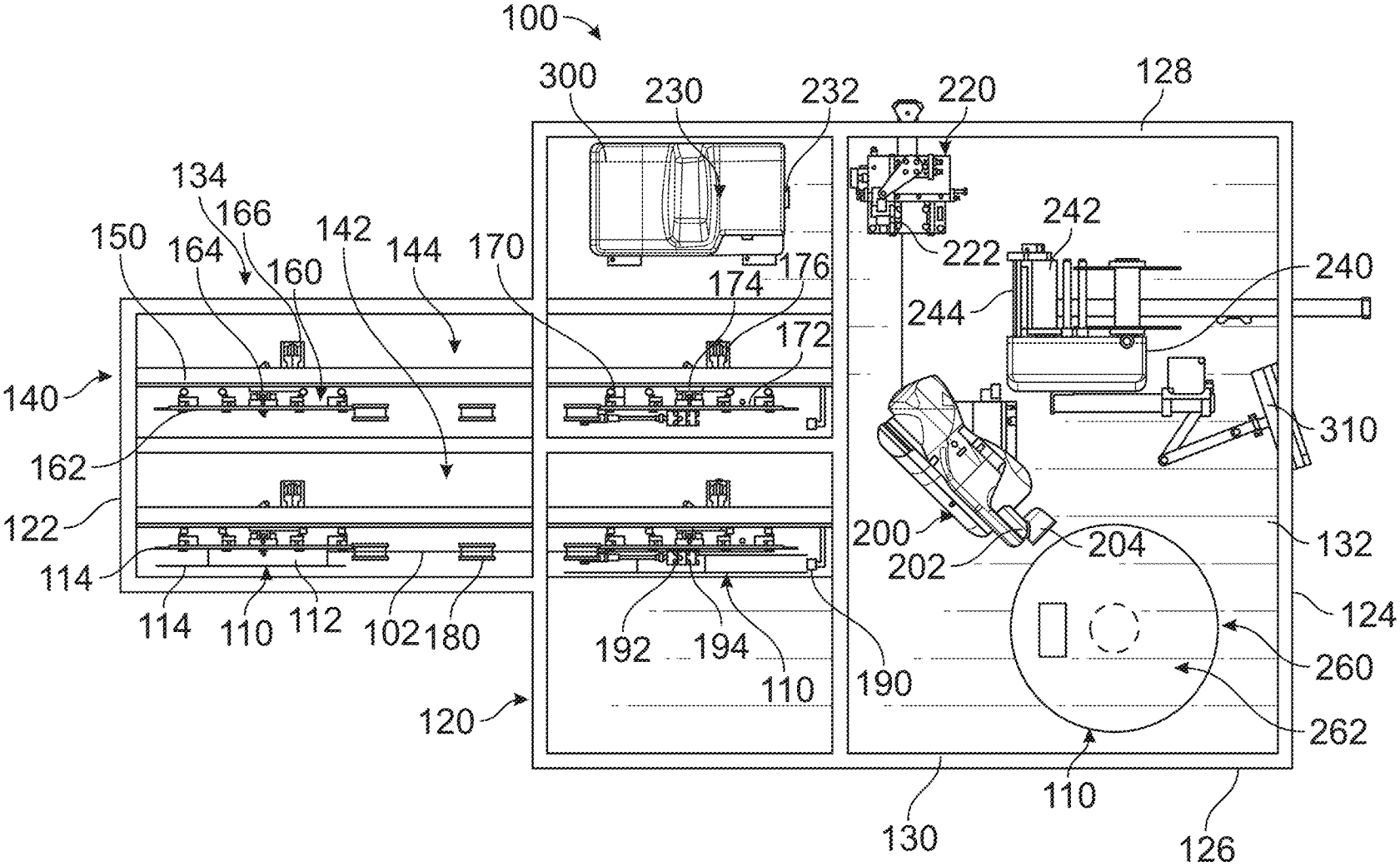
FIG. 2 is a top view of the reel handling machine in accordance with an exemplary embodiment.
Figure 3:
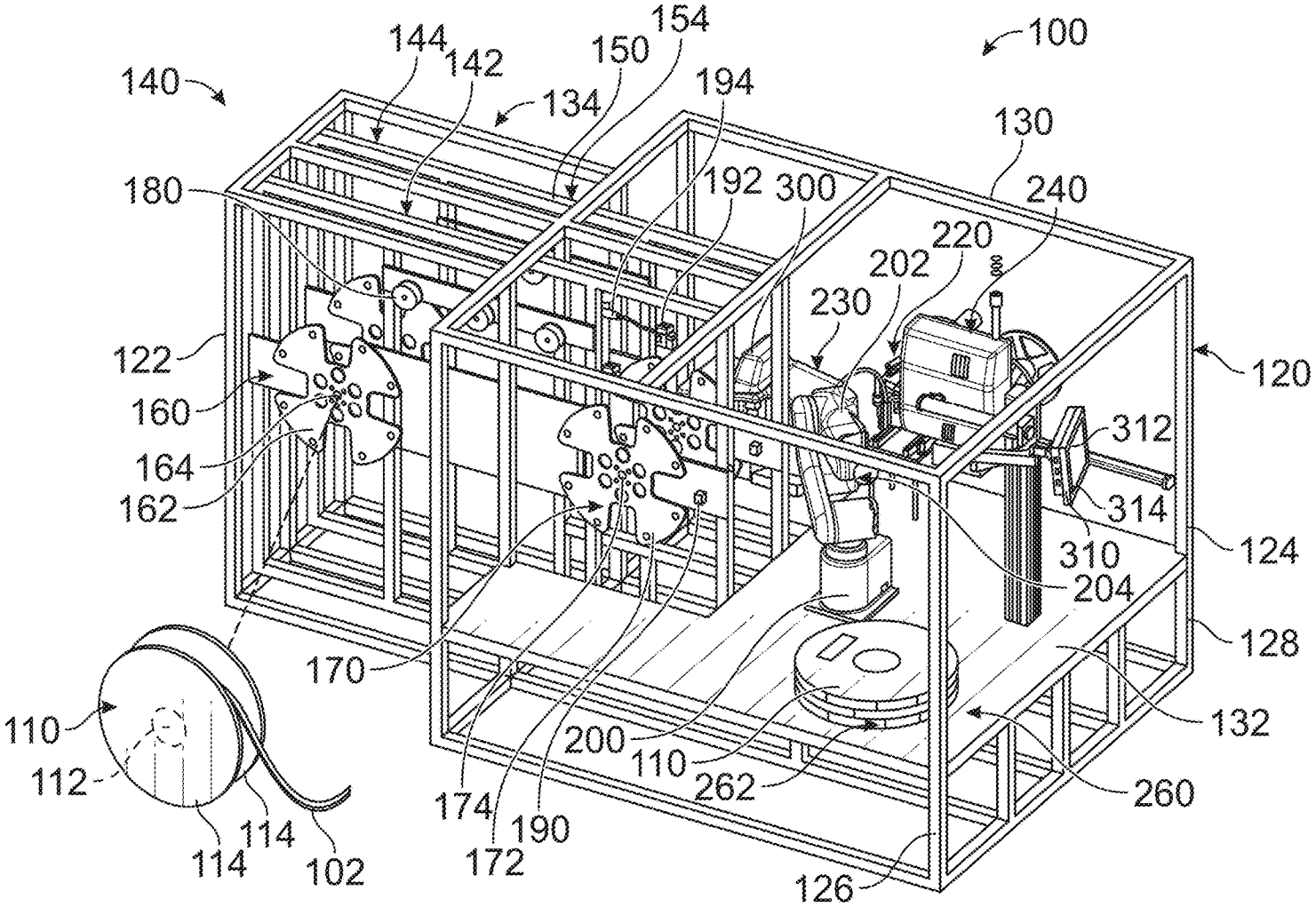
FIG. 3 is a front right perspective view of the reel handling machine in accordance with an exemplary embodiment.

FIG. 1 is a front left perspective view of a reel handling machine 100 in accordance with an exemplary embodiment. FIG. 2 is a top view of the reel handling machine 100 in accordance with an exemplary embodiment. FIG. 3 is a front right perspective view of the reel handling machine 100 in accordance with an exemplary embodiment. The reel handling machine 100 is used for unwinding and rewinding a product strip 102 onto reels 110. For example, the product strip may include electrical contacts arranged along a carrier strip. However, other types of components may be on the product strip. The reel handling machine 100 provides automated reel handling, such as without human intervention, for various processes resulting in a less labor-intensive process, increased throughput, and increased repeatability and quality control. In an exemplary embodiment, the reel handling machine 100 uses vision guidance to automate one or more steps of the reel handling process.

In various embodiments, the reel handling machine 100 is used to unwind the product strip 102 from one reel 110 and rewind the product strip 102 onto another reel 110, such as to change the wind direction of the product strip (for example, between a clockwise wind direction and a counterclockwise wind direction). FIGS. 1 and 2 illustrate some of the reels 110 mounted within the system and FIG. 3 illustrates one of the reels 110 poised for coupling within the system. In various embodiments, the reel handling machine 100 is used to detect strip splices and to detect the end of the product strip 102 during the rewinding process. In various embodiments, the reel handling machine 100 is used to automatically transfer the paper interleaf between the reels. In various embodiments, the reel handling machine 100 is used to remove the re-wound reel 110 and move the re-wound reel 110 to other stations for further processing and/or to stack the re-wound reel 110 after processing. In various embodiments, the reel handling machine 100 is used to automatically tape across the flanges of the reel 110 after the product strip 102 is re-wound onto the reel 110. In various embodiments, the reel handling machine 100 is used for automatically applying a label to the reel 110 at an appropriate position, such as to directly cover a previous label.

In an exemplary embodiment, the reel 110 is a roller or spool manufactured from cardboard pieces. The reel 110 includes a hub 112 and a pair of side walls or flanges 114 coupled to opposite sides of the hub 112. The flanges 114 form a space radially outward of the hub 112 between the flanges 114 that receives the product strip 102. The product strip 102 is wound onto the hub 112 in the space between the flanges 114.

The reel handling machine 100 includes a frame 120 supporting various components of the reel handling machine 100 and the reels 110. The frame 120 has sides 122, 124 extending between a front 126 at a rear 128. A bottom of the frame may be mounted to the floor. In an exemplary embodiment, the frame 120 includes a plurality of frame members 130 may be assembled together, such as being welded or secured together using fasteners. In various embodiments, the front 126 and/or the rear 128 and/or the sides 122, 124 and/or the top may be closed by a panel, wall or cover. In an exemplary embodiment, the frame 120 includes a platform 132 that may support one or more components of the reel handling machine 100. The platform 132 may be at the bottom or alternatively may be elevated at a height above the bottom of the frame 120.

In an exemplary embodiment, the frame 120 includes a reel loading station 134 at the front 122. The reel loading station 134 may be formed by one or more of the frame members 130. The reel handling machine 100 includes one or more re-reeling assemblies 140 at the reel loading station 134. In the illustrated embodiment, the reel handling machine 100 includes two of the re-reeling assemblies 140, which may be referred to hereinafter as a first re-reeling assembly 142 and a second re-reeling assembly 144. The reel handling machine 100 may include greater or fewer re-reeling assemblies 140 in alternative embodiments.

In an exemplary embodiment, each re-reeling assembly 140 is configured to support two of the reels 110, with one of the reels 110 configured to be unwound and the other of the reels 110 configured to be rewound with the product strip 102. Each re-reeling assembly 140 includes a slide frame 150 slidably coupled to the frame 120. The slide frame 150 is movable between a loading position 152 and a winding position 154. In the illustrated embodiment, the slide frame 150 is moved forward out of the frame 120 to the loading position 152 and moved rearward back into the frame 120 to the winding position 154. The slide frame 150 is moved out of the frame 120 to the loaded position 152 to provide access to the reels 110, such as for positioning the reels 110 onto the side of the slide frame 150. In various embodiments, the slide frame 150 is manually moved to the loading position 152 by the operator and the reels 110 may be manually loaded onto the slide frame 150 prior to manually pushing the slide frame 150 back to the winding position 154. However, in alternative embodiments, the slide frame 150 may be automatically moved between the loading position 152 and the winding position 154, such as by an electric actuator, a hydraulic actuator, a pneumatic actuator, or by other automated processes.

The re-reeling assembly 140 includes a reel mount 160 and a re-reel mount 170 both used to support corresponding reels 110. The re-reeling assembly 140 includes one or more guide roller 180 between the reel mount 160 and the re-reel mount 170. The guide rollers 180 are coupled to the slide frame 150. The guide roller 180 guides the product strip 102 between the reel mount 160 and the re-reel mount 170. The guide rollers 180 provide tension in the product strip 102 to improve the winding and unwinding processes.

The reel mount 160 includes a shaft 162 and a hub 164 rotatably mounted to the shaft 162. The hub 164 is used to support the corresponding reel 110. The reel 110 may be secured to the hub 164, such as using fasteners, clips, latches, or other securing elements. In other various embodiments, the reel 110 may be secured to the hub 164 using adhesive. In alternative embodiments, the reel 110 may be secured to the hub 164 using vacuum cups, suction cups, or other types of securing elements. In an exemplary embodiment, the reel mount 160 includes a drive mechanism 166 used for rotating the hub 164 and the reel 110 attached to the hub 164. In various embodiments, the drive mechanism 166 may be an electric motor coupled to the shaft 162. The drive mechanism 166 may be operated in a forward direction and the reverse direction to rotate the hub 164 both clockwise and counterclockwise.

The re-reel mount 170 includes a shaft 172 and a hub 174 rotatably mounted to the shaft 172. The hub 174 is used to support the corresponding reel 110. The reel 110 may be secured to the hub 174, such as using fasteners, clips, latches, or other securing elements. In other various embodiments, the reel 110 may be secured to the hub 174 using adhesive. In alternative embodiments, the reel 110 may be secured to the hub 174 using vacuum cups, suction cups, or other types of securing elements. In an exemplary embodiment, the re-reel mount 170 includes a drive mechanism 176 used for rotating the hub 174 and the reel 110 attached to the hub 174. In various embodiments, the drive mechanism 176 may be an electric motor coupled to the shaft 172. The drive mechanism 176 may be operated in a forward direction and the reverse direction to rotate the hub 174 both clockwise and counterclockwise. The drive mechanism 176 may be operated independently of the drive mechanism 166 of the reel mount 160.

In use, the re-reeling assembly 140 is moved to the loading position. A full reel 110 may be manually coupled to the hub 164 of the reel mount 160. An empty reel 110 may be manually coupled to the hub 174 of the re-reel mount 170. The end of the product strip 102 is removed from the full reel and routed through the guide rollers 180 to the empty reel 110 at the re-reel mount 170. For example, the paper interleaf at the end of the product strip 102 may be unwound from the full reel 110 and routed through the guide rollers 180 to the empty reel 110 at the re-reel mount 170. The end of the paper interleaf may be manually wound a number of turns on the empty reel 110 to secure the paper interleaf to the empty reel 110. The re-reeling assembly 140 may then be moved to the winding position and the unwinding/rewinding process may occur. For example, the drive mechanism 176 of the re-reel mount 170 may be operated to rotate the hub 174 and the corresponding reel 110 to wind product strip 102 onto the empty reel 110. In an exemplary embodiment, the product strip 102 is unwound and rewound on a different reel 110 to change the direction of winding of the product strip 102 on the new reel 110. For example, the direction of winding of the product strip 102 may be necessary for particular manufacturing processes or assembly machines. For example, some assembly machines may require a clockwise winding direction while other assembly machines may require a counterclockwise winding direction. In an exemplary embodiment, it may be necessary to relabel the new reel 110 with a different part number corresponding to the different winding direction. Additionally, it may be necessary to prepare the new reel 110 for shipping, such as by applying tape to the outer edges of the flanges of the reel 110 to prevent inadvertent unwinding of the product strip 102 from the reel 110 during shipping.

In an exemplary embodiment, the re-reeling assembly 140 includes a product strip detector 190 located proximate to the reel mount 160 and/or the re-reel mount 170 to monitor the product strip 102 between the reel mount 160 and the re-reel mount 170. The product strip detector 190 may include a sensor, such as a proximity sensor to detect the product strip 102. In various embodiments, the product strip detector 190 may include an imaging device, such as a camera, for imaging the product strip 102. In various embodiments, the re-reeling assembly 140 may be controlled based on input from the product strip detector 190. For example, the winding and unwinding of the reels 110 may be stopped based on input from the product strip detector 190. The rate of winding and unwinding of the reels 110 may be controlled based on input from the product strip detector 190. In an exemplary embodiment, the product strip detector 190 detects the end of the product strip 102 during the rewinding process, such as to stop the rewinding process when the end of the product strip 102 is detected. The product strip detector 190 may detect the amount of slack or tightness of the product strip 102 between the reel mount 160 and the re-reel mount 170, such as to increase or decrease the speed of the reel mount 160 and/or the re-reel mount 170. The product strip detector 190 may detect strip splices along the length of the product strip 102. The product strip detector 190 may detect damage to the contacts or the carrier strip along the length of the product strip 102.

In an exemplary embodiment, the re-reeling assembly 140 includes an adhesive unit 192 located proximate to the reel mount 160 and/or the re-reel mount 170. The adhesive unit 192 may be used to apply adhesive to portions of the product strip 102 and/or the paper interleaf attached to the end of the product strip 102. In an exemplary embodiment, the adhesive unit 192 includes a dispenser 194, such as a nozzle, for dispensing the adhesive. In an exemplary embodiment, the dispenser 194 is movable relative to the re-reel mount 170. For example, the tip of the dispenser 194 may be variably positionable relative to the re-the reel mount 170, such as to accommodate different lengths of product strip 102 on the reel 110 and/or to accommodate reels having different outer diameters. In an exemplary embodiment, the adhesive unit 192 is automatically operated, such as to automatically dispense the adhesive onto the paper interleaf as the paper interleaf is wound onto the reel 110. Operation of the adhesive unit 192 may be controlled based on input from the product strip detector 190.

In an exemplary embodiment, the reel handling machine 100 includes a reel manipulator 200 positioned proximate to the re-reeling assemblies 140. In an exemplary embodiment, the reel manipulator 200 is coupled to the frame 120, such as being coupled to the platform 132. However, in alternative embodiments, the reel manipulator 200 may be movable relative to the frame 120. For example, the reel manipulator 200 may be included on a mobile transport device, such as an automated guided vehicle (AGV). The reel manipulator 200 is used to remove the rewound reel 110 from the re-reel mount 170 after the product strip 102 is rewound on the reel 110. The reel manipulator 200 is used to move the rewound reel 110 to one or more processing stations for further processing. For example, the reel manipulator 200 may move the rewound reel 110 to a taping station 220 to apply tape to the reel 110. The reel manipulator 200 may additionally, or alternatively, move the rewound reel 110 to an inspection station 230 to inspect the reel 110. The reel manipulator 200 may additionally, or alternatively, move the rewound reel 110 to a labeling station 240 to apply a label to the reel 110. The reel manipulator 200 may additionally, or alternatively, move the rewound reel 110 to a stacking station 260 or other completion station after the reel 110 has been processed, such as for transportation away from the reel handling machine 100.

In an exemplary embodiment, the reel manipulator 200 includes a robotic arm 202 is movable in three-dimensional space. The robotic arm 202 has a reel handler 204 at the end of the robotic arm 202. The reel handler 204 is used to hold the reel 110. In various embodiments, the reel handler 204 may include latches, clips, fasteners or other securing features to secure the reel 110 to the reel handler 204. In other various embodiments, the reel handler 204 may include vacuum cups, suction cups, or other securing features to secure the reel 110 to the reel handler 204. In various embodiments, the reel manipulator 200 is configured to hold the reel 110 in various orientations, such as vertically, horizontally, or at other angles. In various embodiments, the reel manipulator 200 is configured to hold the reel 110 in various angular positions. For example, the reel manipulator 200 may rotate the reel 110 to various angular positions.

In use, the reel manipulator 200 automatically picks up the reel 110 after the product strip 102 is rewound onto the reel 110. For example, a signal may be sent to the reel manipulator 200 when the winding process is complete triggering the reel manipulator 200 to pick up the reel 110 from the re-reel mount 170 of the corresponding re-reeling assembly 140. The reel manipulator 200 then moves the reel 110 to the taping station 220 where tape is applied to the outer perimeter of the reel 110. The reel manipulator 200 then moves the reel 110 to the inspection station 230 for visual inspection, such as by a vision inspection system. The inspection station 230 may inspect the reel 110, such as to inspect the tape applied to the outer perimeter of the reel 110 and/or the location of any label on the reel 110 and/or the data on the label. The reel manipulator 200 then moves the reel 110 to the labeling station 240 where a label may be applied to the side of the reel 110. In an exemplary embodiment, the label is applied over the existing label to cover the existing label, the location of which was determined at the inspection station 230. The reel manipulator 200 may orient the reel 110 at the labeling station 240 to ensure that the label is applied to cover the previous label. For example, the reel 110 may be rotated to a particular orientation such that the label can be applied over the existing label. The reel manipulator 200 then moves the reel 110 to the stacking station 260 to drop off the reel 110 at the stacking station 260. The reel manipulator 200 is then ready to pick up the next reel 110 from the re-reeling assemblies 140.

In an exemplary embodiment, the taping station 220 includes a tape applicator 222 coupled to the frame 120. For example, the tape applicator 222 may be coupled to the platform 132. The tape applicator 222 applies tape to the outer periphery of the reel 110. For example, the tape may be applied to the outer side surfaces of the flanges 114 and span across the gap between the flanges 114. The tape may prevent the product strip from inadvertently unwinding from the reel 110. In an exemplary embodiment, multiple segments of the tape are applied at different locations around the outer periphery of the reel 110. For example, four segments of the tape may be applied at 90° intervals apart from each other. Greater or fewer segments of the tape may be applied in alternative embodiments. In an exemplary embodiment, the reel manipulator 200 rotates the reel 110 at the taping station 220 to change the orientation of the reel 110 relative to the tape applicator 222, such as to apply the tape at different portions of the reel 110. In alternative embodiments, a continuous piece of tape is applied circumferentially around the outer periphery of the reel 110.

In an exemplary embodiment, the inspection station 230 includes an imaging device 232 for imaging the reel 110. The imaging device 232 may be a camera. The imaging device 232 may image the product strip 102 wound on the reel 110 and/or may image the tape applied to the reel 110 and/or may image other portions of the reel 110, such as the flanges 114. The images are analyzed to detect problems or flaws. In an exemplary embodiment, the imaging device 232 images the side of the reel 110 to detect a location of a label on the reel 110. For example, because the reels 110 may be reused, previous labels may be present and need to be removed or covered up. The location of the label may be determined to control operation of the reel manipulator 200, such as to cause the reel manipulator 200 to rotate the reel 110 a determined angular distance for positioning the reel 110 at the labeling station 240 (for example, to align the existing label within the labeling station such that the new label covers up the old label). In alternative embodiments, the reel manipulator 200 may rotate the reel 110 at the inspection station 230 until the old label is at a predetermined angular position relative to the imaging device 232 (for example, at 0° or another angular position), wherein the angular position is maintained by the reel manipulator 200 as the reel 110 is moved from the inspection station 230 to the labeling station 240. In other alternative embodiments, the inspection station 230 may be located at the labeling station 240 such that the reel 110 is not moved between the stations, but rather is properly oriented within the labeling station 240 using the imaging device 232. In various embodiments, multiple inspection stations 230 may be provided, such as at other stations (for example, at the taping station 220).

In an exemplary embodiment, the labeling station 240 includes a label printer 242 and a label applicator 244. The label printer 242 prints a new label for the reel 110. In various embodiments, information printed on the label printer 242 may be based on data gathered by the imaging device 232. For example, the system may determine the wind direction based on the image and/or may determine the type of product strip 102 based on the image and/or may determine the size or type of contact on the product strip 102 based on the image and/or may determine the size of the reel 110 based on the image and/or may determine other data based on the image, such data being used to generate the information printed on the label by the label printer 242. The label applicator 244 applies the label printer by the label printer 242 directly onto the reel 110. In an exemplary embodiment, the label applicator 244 applies the label in the same location as the existing label to cover the existing label. In various embodiments, the reel manipulator 200 positions the reel 110 relative to the label applicator 244 such that the new label is applied at the proper location to cover the old label. In various embodiments, the label applicator 244 is a roller applicator. In other various embodiments, the label applicator 244 includes a vacuum gripper configured to pick and place the label onto the reel 110. Other types of label applicators may be used in alternative embodiments.

In various embodiments, after the label is applied to the reel 110, the reel manipulator 200 may position the reel 110 at the inspection station 230 to image the newly applied label. The image is analyzed to determine proper application of the label to the reel 110. The image is analyzed to determine that a single label is visible on the reel 110. The image is analyzed to determine that the correct information is printed on the label.

In an exemplary embodiment, the reel manipulator 200 moves the labeled reel 110 to the stacking station 260. The reel 110 is placed on a reel stack 262 and released by the reel manipulator 200. In various embodiments, the reel stack 262 may be stacked on the platform 132. Optionally, the reel stack 262 may be stacked on a pallet for removal from the platform 132. After the reel 110 is released by the reel manipulator 200, the reel manipulator 200 is able to pick up the next reel 110 from the re-reeling assembly 140.

In an exemplary embodiment, the reel handling machine 100 includes a controller 300 for controlling the automated processes of the reel handling machine 100. The controller 300 may be operably coupled to the reel manipulator 200 and/or the tape applicator 222 and/or the imaging device 232 and/or the label printer 242 and/or the label applicator 244. The controller 300 may be operably coupled to the drive mechanisms 166, 176 of the re-reeling assembly 140. The controller 300 may be operably coupled to the adhesive unit 192 of the re-reeling assembly 140. Control of the various components may be controlled based on inputs or signals from other components.

In an exemplary embodiment, the controller 300 is operably coupled to a user interface 310. The user interface 310 may include a display 312 and one or more inputs 314, such as buttons, dials, touchscreens, pointer devices, and the like. In the illustrated embodiment, the user interface 310 is coupled to the frame 120, such as through the labeling station 240. In alternative embodiments, the user interface 310 may be a mobile device, such as a laptop or other handheld device. The operator may control various operations of the reel handling machine 100 through the user interface 310. For example, control signals may be transmitted to the controller 300 to control the other automated components of the reel handling machine 100.

Figure 4:
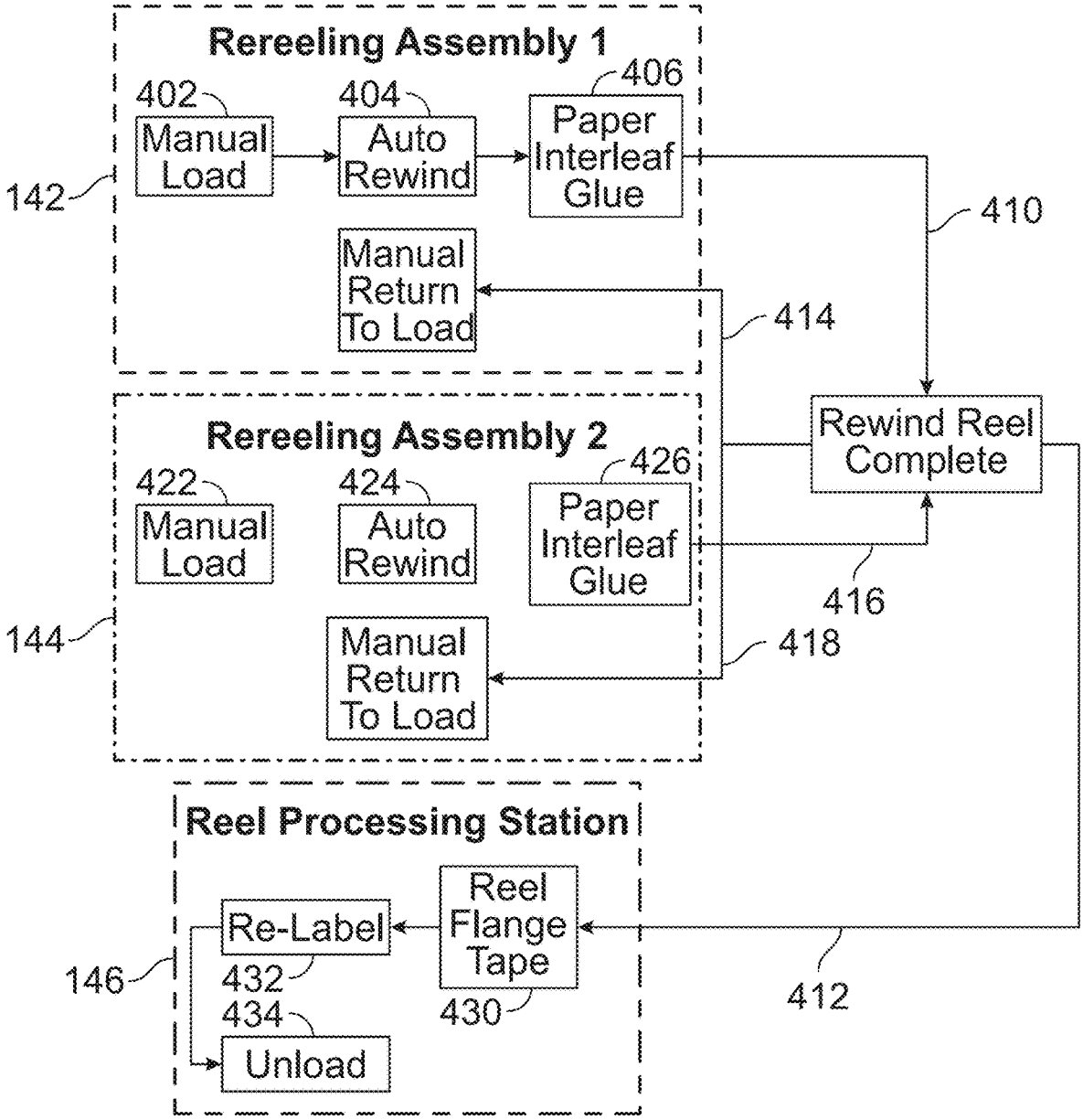
FIG. 4 is a flowchart illustrating various operations of the reel handling machine in accordance with an exemplary embodiment.

FIG. 4 is a flowchart illustrating various operations of the reel handling machine 100 in accordance with an exemplary embodiment. In the illustrated flowchart, the system includes two of the re-reeling assemblies, such as the first re-reeling assembly 142 and the second re-reeling assembly 144. It is understood that greater or fewer re-reeling assemblies may be used in alternative embodiments. Operations performed at the re-reeling assemblies 142, 144 may be performed independently of each other. In the illustrated flowchart, the system includes a reel processing station 146 separate from the re-reeling assemblies. Operations performed in the reel processing station 146 may be performed independent of the operations performed at the re-reeling assemblies 142, 144. For example, reels that are independently re-reeled at the re-reeling assemblies 142, 144 may be removed from the re-reeling assemblies 142, 144 and processed at the reel processing station 146.

At the first re-reeling assembly 142, at step 402, two of the reels may be manually loaded into the first re-reeling assembly 142. For example, a full reel may be manually loaded onto a reel mount and an empty reel may be manually loaded onto a re-reel mount. During manual loading, the operator physically picks up the reels and attaches the reels to the mounts. The end of the product strip is partially unwound and routed through guide features, such as the guide rollers to the empty reel. In an exemplary embodiment, the paper interleaf at the end of the product strip is routed through the guide features to the empty reel. The end of the paper interleaf and/or the end of the product strip are partially, manually wound onto the empty reel. At step 404, the product strip is automatically re-reeled from the first reel onto the second reel. Drive mechanisms are used to rotate the mounts, and thus the reels, during the automatic re-reeling. In an exemplary embodiment, a vision system is used to monitor the product strip during the re-reeling process, such as to detect splices, damage, and the end of the product strip. Signals from the vision system may be used to control the re-reeling process, such as to control the speed of the drive mechanisms and/or to stop the rotating of the mounts when damages detected and/or when the end of the product strip is detected. At step 406, a paper interleaf is secured to the end of the product strip and secured to the winding to hold the product strip in the wound condition on the reel. The first re-reeling assembly 142 may include an adhesive dispenser to secure the paper interleaf on the winding.

At 410, the system signals completion of the rewinding process on the reel. Such completion signal triggers the next phase of processing of the reel. At 412, the system activates a reel manipulator to remove the rewound reel and transport the reel to the reel processing station 146. After the reel is removed, at 414, the system signals that the first re-reeling assembly 142 is ready for manual reloading.

The second re-reeling assembly 144 may be operated in the same manner as the first re-reeling assembly 142. At the second re-reeling assembly 144, at step 422, two of the reels may be manually loaded into the second re-reeling assembly 144. For example, a full reel may be manually loaded onto a reel mount and an empty reel may be manually loaded onto a re-reel mount. During manual loading, the operator physically picks up the reels and attaches the reels to the mounts. The end of the product strip is partially unwound and routed through guide features, such as the guide rollers to the empty reel. In an exemplary embodiment, the paper interleaf at the end of the product strip is routed through the guide features to the empty reel. The end of the paper interleaf and/or the end of the product strip are partially, manually wound onto the empty reel. At step 424, the product strip is automatically re-reeled from the first reel onto the second reel. Drive mechanisms are used to rotate the mounts, and thus the reels, during the automatic re-reeling. In an exemplary embodiment, a vision system is used to monitor the product strip during the re-reeling process, such as to detect splices, damage, and the end of the product strip. Signals from the vision system may be used to control the re-reeling process, such as to control the speed of the drive mechanisms and/or to stop the rotating of the mounts when damages detected and/or when the end of the product strip is detected. At step 426, a paper interleaf is secured to the end of the product strip and secured to the winding to hold the product strip in the wound condition on the reel. The second re-reeling assembly 144 may include an adhesive dispenser to secure the paper interleaf on the winding.

At 416, the system signals completion of the rewinding process on the reel. Such completion signal triggers the next phase of processing of the reel. At 412, the system activates the reel manipulator to remove the rewound reel and transport the reel to the reel processing station 146. After the reel is removed, at 418, the system signals that the second re-reeling assembly 144 is ready for manual reloading.

At 430, the reel manipulator moves the reel to a tape applicator to apply tape across the flanges of the reel. At 432, the reel manipulator moves the reel to a label applicator to apply a label to a side of the reel. At 434, the reel manipulator moves the reel to a reel stack to unload the finished reel onto the reel stack. The reel processing station 146 may include an imaging device that images the reel before and/or after processing at the various steps. For example, the imaging device may image the reel prior to tape application or post tape application. The imaging device may image the reel prior to label application or post label application. The imaging device may image the reel prior to unloading at the reel stack. The reel may be further processed and/or manipulated by the reel manipulator based on the images by the imaging device.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A reel handling machine comprising:

a frame;

a first re-reeling assembly coupled to the frame, the first re-reeling assembly including a first reel mount and a first re-reel mount, the first reel mount configured to support a first reel, the first re-reel mount configured to support a second reel, the first re-reeling assembly operated to unwind a product strip from the first reel and rewind the product strip on the second reel in an opposite wind direction from the first reel;

a second re-reeling assembly coupled to the frame, the second re-reeling assembly including a second reel mount and a second re-reel mount, the second reel mount configured to support a third reel, the second re-reel mount configured to support a fourth reel, the second re-reeling assembly operated to unwind a product strip from the third reel and rewind the product strip on the fourth reel in an opposite wind direction from the third reel; and a reel manipulator positioned proximate to the first and second re-reeling assemblies, the reel manipulator configured to automatically remove the second reel from the first re-reel mount after the product strip is rewound on the second reel and move the second reel to a remote location, the reel manipulator configured to automatically remove the fourth reel from the second re-reel mount after the product strip is rewound on the fourth reel and move the fourth reel to a remote location.

2. The reel handling machine of claim 1, wherein the first re-reeling assembly is slidably coupled to the frame and movable between a loading position and a winding position, the first and second reels being loaded onto the first reel mount and the first re-reel mount, respectively, at the loading position, the product strip being unwound from the first reel and being wound onto the second reel at the winding position, and wherein the second re-reeling assembly is slidably coupled to the frame and movable between a loading position and a winding position, the third and fourth reels being loaded onto the second reel mount and the second re-reel mount, respectively, at the loading position, the product strip being unwound from the third reel and being wound onto the fourth reel at the winding position.

3. The reel handling machine of claim 2, wherein the first re-reeling assembly is slidable relative to the frame independent from the second re-reeling assembly.

4. The reel handling machine of claim 1, wherein the first re-reel mount includes a shaft and a hub rotatably coupled to the shaft, a side of the second reel being coupled to the hub.

5. The reel handling machine of claim 4, wherein the first re-reel mount includes a drive mechanism configured to rotate the hub to rotate the second reel to rewind the product strip onto the second reel.

6. The reel handling machine of claim 1, further comprising a reel taping mechanism coupled to the frame, the reel taping mechanism having a tape applicator configured to apply tape across flanges of the second reel when presented to the tape applicator by the reel manipulator, the tape applicator configured to apply tape across flanges of the fourth reel when presented to the tape applicator by the reel manipulator.

7. The reel handling machine of claim 1, further comprising a reel labeling mechanism coupled to the frame, the reel labeling mechanism having a label applicator configured to apply a label to a side of the second reel when presented to the label applicator by the reel manipulator, the label applicator configured to apply a label to a side of the fourth reel when presented to the label applicator by the reel manipulator.

8. The reel handling machine of claim 1, further comprising a product strip detector located proximate to the first re-reeling assembly to monitor the product strip between the first reel mount and the first re-reel mount, the rewinding process being automatically controlled based on input from the product strip detector.

9. The reel handling machine of claim 1, further comprising an adhesive unit located proximate to the first re-reeling assembly to apply adhesive to a paper interleaf at an end of the product strip of the first re-reeling assembly.

10. The reel handling machine of claim 9, wherein the adhesive unit includes a dispenser being variably positionable relative to the first re-reel mount.

11. The reel handling machine of claim 1, wherein the first re-reeling assembly includes guide rollers between the first reel mount and the first re-reel mount to guide the product strip of the first re-reeling assembly therebetween.

12. The reel handling machine of claim 1, wherein the reel manipulator is coupled to the frame in a fixed location relative to the frame, the reel manipulator including a robotic arm movable in three-dimensional space relative to the fixed location.

13. The reel handling machine of claim 1, further comprising a reel stack supported by the frame, the reel manipulator configured to move the second reel to the reel stack to drop off the second reel at the reel stack.

14. The reel handling machine of claim 1, further comprising a third re-reeling assembly coupled to the frame, the third re-reeling assembly including a third reel mount and a third re-reel mount, the third reel mount configured to support a fifth reel, the third re-reel mount configured to support a sixth reel, the third re-reeling assembly operated to unwind a product strip from the fifth reel and rewind the product strip on the sixth reel.

15. A reel handling machine comprising:

a frame;

a re-reeling assembly coupled to the frame, the re-reeling assembly including a reel mount and a re-reel mount, the reel mount configured to support a first reel, the re-reel mount configured to support a second reel, the re-reeling assembly operated to unwind a product strip from the first reel and rewind the product strip on the second reel;

a reel manipulator positioned proximate to the re-reeling assembly, the reel manipulator configured to automatically remove the second reel from the re-reel mount after the product strip is rewound on the second reel and move the second reel to a remote location;

a reel taping mechanism coupled to the frame, the reel taping mechanism having a tape applicator configured to apply tape across flanges of the second reel, wherein the reel manipulator positions the second reel at the reel taping mechanism while the tape is applied across the flanges of the second reel.

16. The reel handling machine of claim 15, wherein the reel manipulator is configured to rotate the second reel relative to the tape applicator to apply the tape to different sections of the second reel.

17. The reel handling machine of claim 15, wherein the tape applicator applies multiple segments of the tape to the second reel.

18. A reel handling machine comprising:

a frame;

a re-reeling assembly coupled to the frame, the re-reeling assembly including a reel mount and a re-reel mount, the reel mount configured to support a first reel, the re-reel mount configured to support a second reel, the re-reeling assembly operated to unwind a product strip from the first reel and rewind the product strip on the second reel;

a reel manipulator positioned proximate to the re-reeling assembly, the reel manipulator configured to automatically remove the second reel from the re-reel mount after the product strip is rewound on the second reel and move the second reel to a remote location;

a reel labeling mechanism coupled to the frame, the reel labeling mechanism having a label applicator configured to apply a label to a side of the second reel, wherein the reel manipulator positions the second reel at the reel labeling mechanism while the label is applied to the side of the second reel.

19. The reel handling machine of claim 18, further comprising a vision system imaging the second reel, the label applicator applying the label to the side of the second reel based on an image of the second reel.

20. The reel handling machine of claim 18, wherein the reel manipulator is configured to rotate the second reel relative to the label applicator to position the second reel at a predetermined angular position relative to the label applicator for application of the label to the side of the second reel.

* * * * *